United States Patent [19]

Pellis

[11] Patent Number: 4,791,908

[45] Date of Patent: Dec. 20, 1988

[54] BOWSTRING RELEASE MECHANISM

[75] Inventor: Mario A. Pellis, Mouille Point, South Africa

[73] Assignee: Pro Line Company, Hastings, Mich.

[21] Appl. No.: 97,849

[22] Filed: Sep. 17, 1987

[51] Int. Cl.[4] ..... F41B 5/00; F41C 17/00

[52] U.S. Cl. ..... 124/35 A

[58] Field of Search ..... 124/23 R, 24 R, 25, 124/35 A, 35 R, 40, 86, 90

[56] References Cited

U.S. PATENT DOCUMENTS

| | | | |
|---|---|---|---|
| 2,905,167 | 9/1959 | Abrams et al. | 124/40 |
| 3,446,200 | 8/1966 | Gross . | |
| 3,898,974 | 8/1974 | Keck | 124/35 A |
| 3,937,206 | 2/1976 | Wilson | 124/35 A |
| 4,004,564 | 1/1977 | Castonguay | 124/35 A |
| 4,009,703 | 3/1977 | Cunningham, Sr. | 124/35 A |
| 4,169,455 | 10/1979 | Wilson | 124/35 A |
| 4,391,263 | 7/1983 | Dodge | 124/35 A |
| 4,407,260 | 10/1983 | Lyons | 124/35 A |
| 4,539,968 | 9/1985 | Garvison | 124/35 A |
| 4,567,875 | 2/1986 | Fletcher | 124/35 A |
| 4,612,907 | 9/1986 | Gantt | 124/35 A |
| 4,625,705 | 12/1986 | Willits | 124/35 A |
| 4,648,483 | 3/1987 | Skyba | 182/187 |
| 4,672,945 | 6/1987 | Carlton | 124/35 A |

*Primary Examiner*—Randolph A. Reese
*Assistant Examiner*—John A. Ricci
*Attorney, Agent, or Firm*—Varnum, Riddering, Schmidt & Howlett

[57] ABSTRACT

A bowstring release mechanism is disclosed which is operable in two alternative modes to draw and release an archery bowstring. In both modes the bowstring is held by means of a latch member which is moved to a cocked position, the latch member being held in the cocked position by a sear. The bowstring is then drawn, and the latch member is released from its cocked position to release the bowstring. In one such mode, manual pressure is applied to the sear to release the latch member from its cocked position. In the other mode, manual pressure is applied to the sear during the cocking operation and then released to release the latch member from its cocked position. Structure is disclosed which enable the mechanism to be operable in either of such modes at the election of the archer.

6 Claims, 5 Drawing Sheets

BOWSTRING RELEASE MECHANISM

BACKGROUND OF THE INVENTION

This invention relates to a mechanism for assisting an archer in drawing and releasing a bowstring to launch an arrow.

An archer traditionally has employed his fingers to grasp and draw a bowstring, and when he has judged that an arrow fitted to the bowstring has been aligned with the target, he has simply released the bowstring by allowing it to slip from his fingers. However, it is virtually impossible to release a bowstring in this manner without causing the string to slide off the fingers. The resulting friction between fingers and bowstring causes the string to rotate and the fingers, however inadvertently, apply a lateral torque, all of which causes the path of the arrow to be distorted; that is, the arrow is made to deviate from its intended trajectory.

The foregoing problem has long been recognized in the art of archery, and therefore various expedients have been devised to permit the bowstring to be released in the full forward direction with a minimum of vibration and lateral deviation, or preferably, without any deviation at all.

One such expedient comprises a simple ring or handle provided with an integral hook for engaging the bowstring. To release the string when it has been drawn, the archer rotates the ring until the string slips off the hook. However, string vibration and lateral torque, though diminished, are not eliminated by such a device.

In recent years, a number of release mechanisms made up of moving components have been developed for drawing and releasing a bowstring without engaging it directly or indirectly with the fingers. These mechanisms have in common a latch member mounted in a housing or body member for movement relative thereto to and from a cocked position. The latch member is formed to grasp and hold a cord by a portion thereof upon movement to the cocked position. Sear means carried by the body member releasably maintain the latch member in the cocked position but are manually operable to release the latch member for movement from the cocked position, thus to release the cord.

It is to be noted at this juncture that the term "cord", as it is used in this specification, may refer to the bowstring itself, or it may refer to a so-called draw cord. The latter element, which has also been called a "release rope", "draw rope", "rope loop", or simply a "rope" or "cord", may be employed in conjunction with certain bowstring release mechanisms, if the archer so prefers, to avoid direct contact of the mechanism with the bowstring. Instead, it is the draw cord which is releasably engaged by the release mechanism and which grasps the bowstring by being looped around it. Use of a draw cord is explained with greater particularity hereinbelow.

A representative example of known bowstring release mechanisms is disclosed in U.S. Pat. No. 3,937,206, issued Feb. 10, 1976 to Hugh R. Wilson and entitled "Bowstring Release Mechanism". In this example, a latch member or release wheel is pivotally carried by a body member or housing. The release wheel is provided with a peripheral notch for grasping and releasably holding a bowstring. Alternatively, a draw cord or rope loop may be employed, the extreme ends of the rope loop being secured to the mechanism. The free end or bight of the rope loop is brought around the bowstring and received in the peripheral notch of the release wheel, and the release wheel is moved to and held in a cocked position. A trigger block pivotally mounted in the housing comprises sear means which are manually operable to free the release wheel for movement from the cocked position to release the drawn bowstring.

Other examples of known bowstring release mechanisms are disclosed in U.S. Pat. Nos. 4,612,907 to J. V. Gantt; 4,567,875 to J. D. Fletcher; 4,407,260 to L. W. Lyons; 4,391,263 to P. A. Dodge; 4,169,455 to H. R. Wilson; 4,009,703 to J. L. Cunningham, Sr.; 3,898,974 to E. L. Keck; and 3,446,200 to N. M. Gross.

It is important to note that the sear means or equivalent disclosed in all the prior patents identified above are actuated in the manner in which the sears of firearms are actuated; that is, manual pressure must be applied to a trigger of one sort or another by one or more of the archer's fingers or, in some cases, by his thumb. This may present a further problem to certain archers, as follows.

Some archers are so conditioned to a releasing or relaxing action of the fingers in releasing a drawn bowstring that for them it has become virtually a reflex to relax or open the fingers—to let go, as it were—the instant the bow sight and the target appear to be aligned with the archer's eye. When attempting to employ bowstring release mechanisms of the types disclosed in the patents identified hereinabove, such archers tend to let the mechanism escape from the hand entirely instead of applying positive pressure to the trigger element. As a result, the release mechanism is not actuated; it remains attached to the bowstring and may strike the archer's other hand or arm or inflict damage on the bow or its attachments.

SUMMARY OF THE INVENTION

In a bowstring release mechanism constructed in accordance with the present invention, the sear means comprises a sear detent movable to and from a cocking position in which it engages the latch member to hold the latch member in its cocked position. The sear means also include a sear actuator and a biasing means, the sear actuator being urged by the biasing means in a first direction from a first sear position to an intermediate neutral position to a second sear position. In both of the sear positions, the sear actuator holds the sear detent in its cocking position in engagement with the latch member. The sear actuator may be moved in the direction opposite to the first direction and against the urging of the biasing means by applying manual pressure. When the sear actuator is moved to the neutral position, either by applying manual pressure or under the urging of the biasing means, the sear detent is permitted to move from its cocking position out of holding engagement with the latch member, whereby the latch member is free to be moved from its cocked position, as by the force exerted upon it by a drawn bowstring, to release the bowstring. Thus, two alternative modes of operation are offered to the archer. If he prefers to apply positive manual pressure to the sear means to release the bowstring, in a manner similar to that in which a firearm is discharged by pulling the trigger, he may simply refrain from applying any manual pressure to the sear means during the cocking operation, whereby the sear actuator will move under the urging of the biasing means from the neutral position to the second sear position. The archer then applies positive manual pressure to the sear actuator to return it against the biasing means to the neutral position, thereby freeing the sear detent from its cocking position, and thus the latch member from its cocked position, to release the bowstring.

Alternatively, the archer may apply positive manual pressure to the sear actuator during the cocking operation in a direction against the urging of the biasing means, moving it from the neutral position to the first sear position. When he wishes to release the bowstring, he simply removes the manual pressure from the sear actuator to permit it to return to the neutral position, in a manner similar to that employed when the bowstring is grasped directly by the fingers drawn and released.

Other objects, features and advantages of the invention will be apparent from the ensuing description in conjunction with the accompanying drawings.

THE DRAWINGS

THE PREFERRED EMBODIMENT

Figure 1:
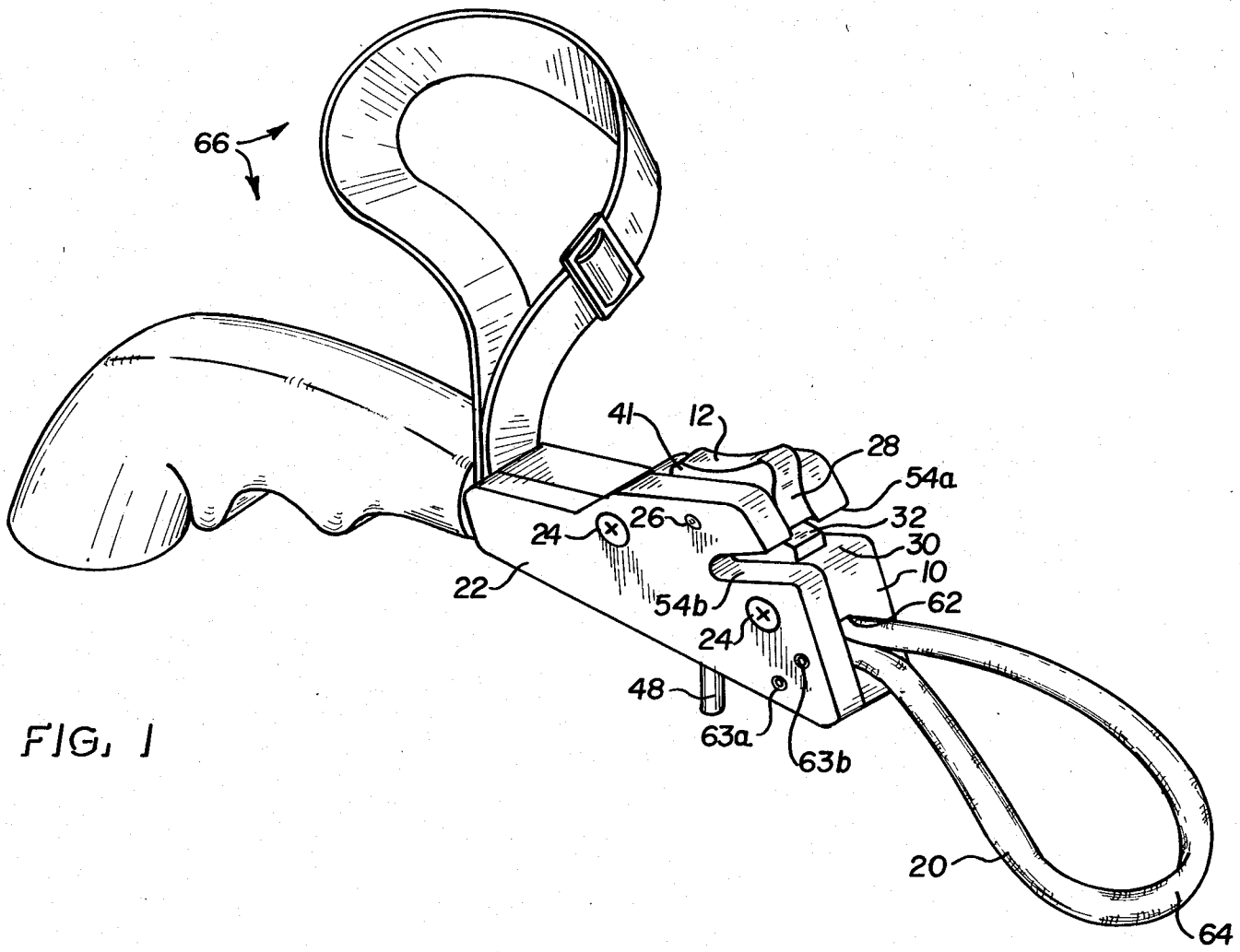
FIG. 1 is a perspective view of a bowstring release mechanism in accordance with the invention.

Referring to the drawings, a bowstring release mechanism in accordance with the invention comprises principally a body member 10, a latch member 12, and sear means including a sear detent 14, a sear actuator or slide 16, and biasing means in the form of a sear spring 18, all preferably formed of suitable metals. A draw cord 20 may be included as shown in FIG. 1 and FIGS. 3 to 7. If the archer prefers, it may be omitted or removed as it has been in the modification shown in FIG. 2.

Figure 2:
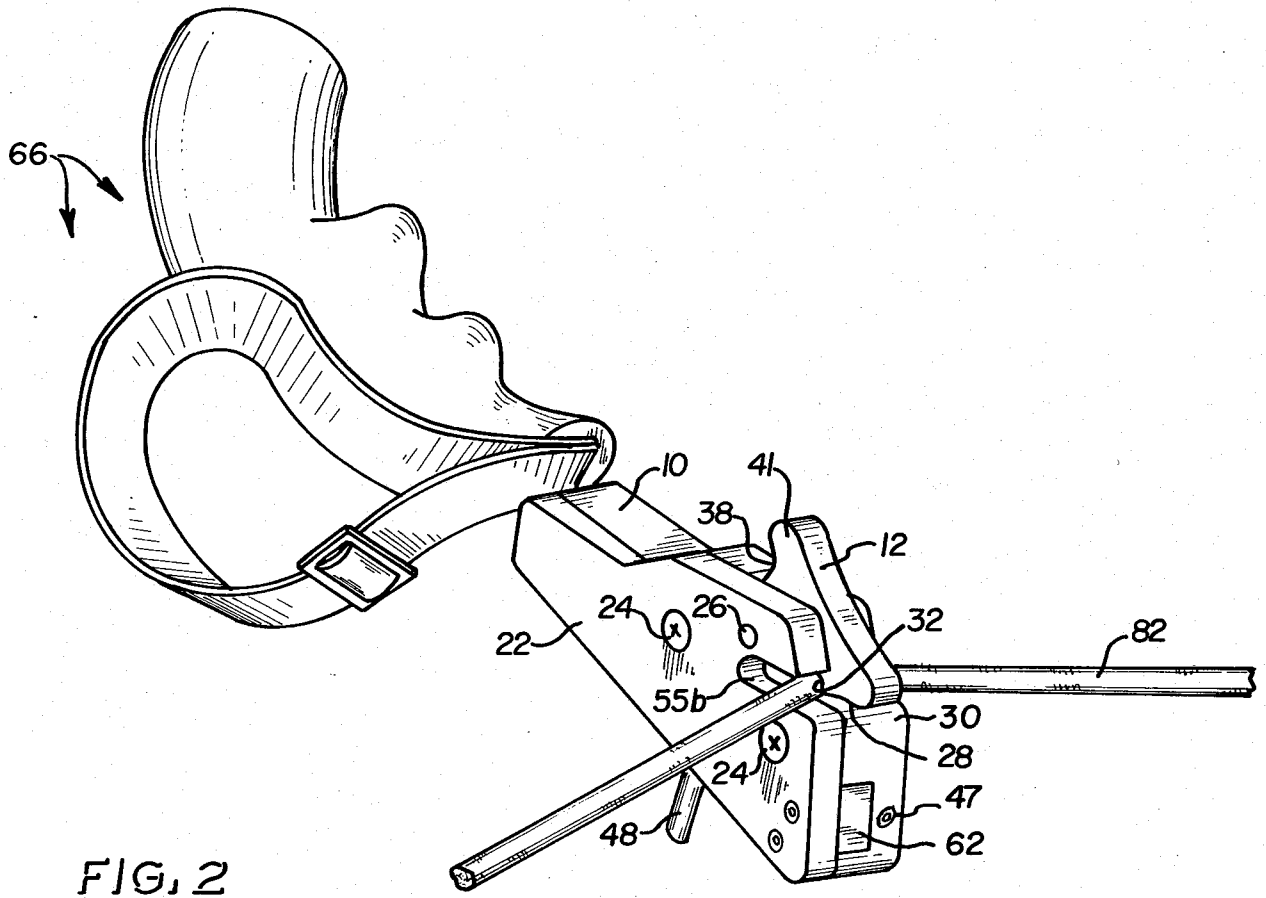
FIG. 2 is similar perspective view of a bowstring release mechanism constructed in accordance with the invention, but modified slightly from the construction shown in FIG. 1 and illustrating an alternative mode of operation.
Figure 3:
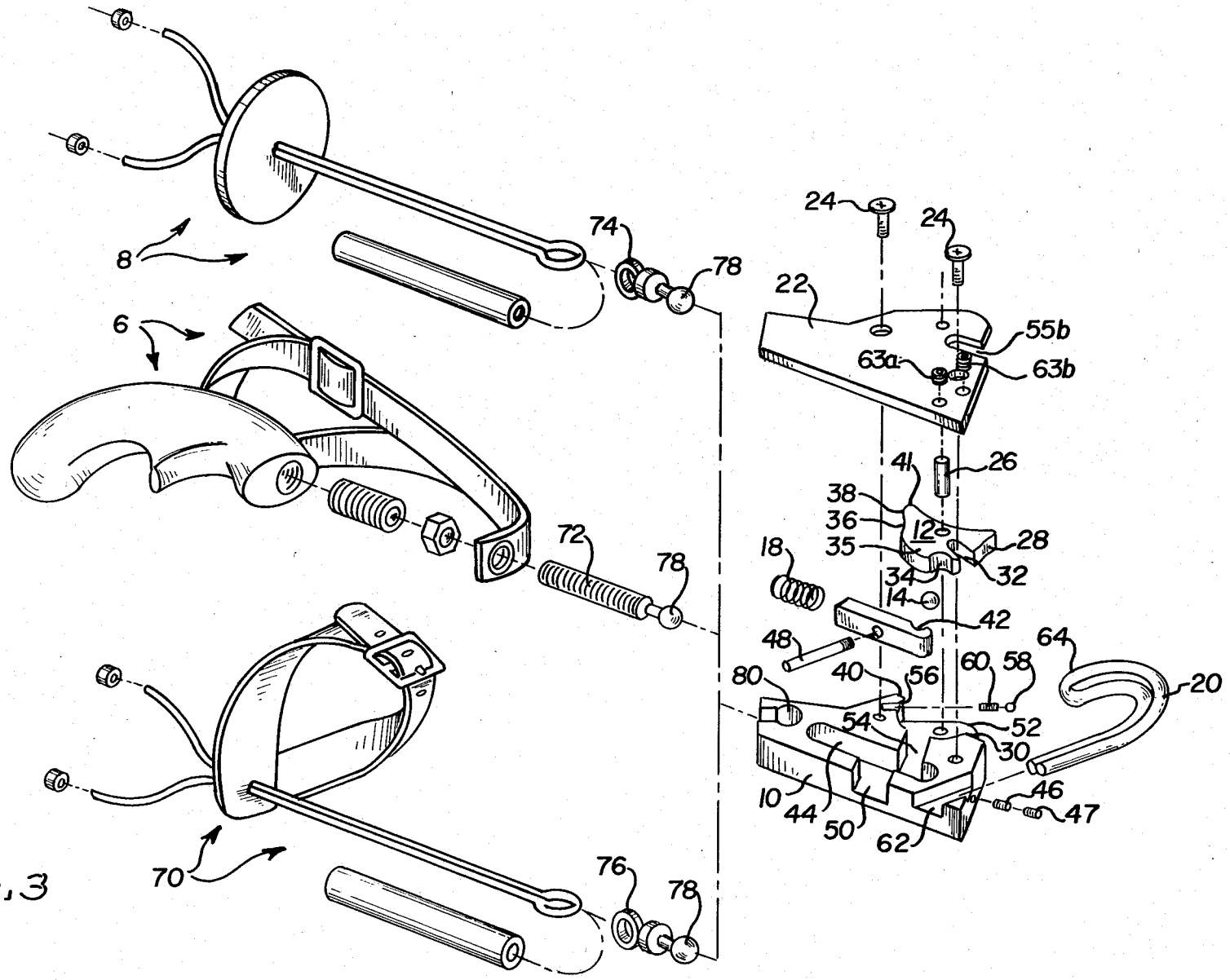
FIG. 3 is a reduced perspective view of a bowstring release mechanism constructed in accordance with the invention, showing the mechanism in a disassembled condition and also showing alternative handle elements.

A cover member 22, shown in FIGS. 1, 2 and 3, is affixed to the body member 10 in well-known manner by means of fasteners such as machine screws 24. The cover member has been removed in the views represented in FIGS. 4 to 7, inclusive.

Latch member 12 is mounted on body member 10 for limited rotation relative thereto by means of a pin 26 received in aligned apertures in the body member, the latch member and cover member 22. The periphery of latch member 12 includes a forward stop surface 28 adapted to engage a corresponding stop surface 30 provided on the body member to limit rotation of the latch member in the clockwise direction as viewed in the drawings, an indented surface defining a cord-receiving notch 32, a second indented surface defining a sear notch 34, a convex cam surface 35 extending between sear notch 34 and a third indented surface defining a keeper notch 36, and a rear stop surface 38 adapted to engage a corresponding stop surface 40 provided on body member 10 to limit rotation of latch member 12 in the counterclockwise direction. The rear stop surface is provided on a rearward projection or protuberance of the latch member which forms a cocking lever 41.

Sear slide 16 is an elongated element of generally rectangular cross section. An indented surface is provided at its upper side near its forward end to define a detent notch 42. Sear slide 16 is slidably received for reciprocating movement in an elongated slot 44 formed in body member 10. Also received in slot 44 and compressed between the rearward ends of the slot and sear slide 16 is the sear spring 18, which may comprise a simple coil spring. A set screw 46 is threadedly received in body member 10 and extends into slot 44 to adjustably limit forward movement of sear slide 16. Set screw 46 is prevented from moving from its adjusted position by means of a lock screw 47 received in the same aperture, and which may be removed when the archer wishes to adjust set screw 46 and replaced to lock it in its newly adjusted position.

Sear detent 14 comprises a simple spherical element, suitably a discrete ball bearing, the contours of sear notch 34 and detent notch 42 being complementary to its circular contour.

A trigger 48 is threadedly received in sear slide 16 to depend from its lower surface. Trigger 48 extends from sear slide 16 to the exterior of the mechanism by way of a trigger slot 50 formed in body member 10 and communicating with slot 44.

Also communicating with slot 44 at an intermediate portion thereof and with a recess 52 formed in the body member to receive latch member 12 is a detent slot 54, the function of which is made clear hereinafter. The opposite ends of detent slot 54 are closed by the latch member and the sear slide, respectively.

Cord slots **55*a* and 55*b* are formed in body member 10 and cover member 22, respectively, and aligned when the two members are assembled, to provide egress for draw cord 20 or the bowstring when a portion of either is received in notch 32, as is best represented in FIG. 2**.

Received in a keeper slot 56 formed in body member 10 is a keeper 58 and a keeper spring 60. The latter, which may be a simple coil spring, is compressed between keeper 58 and the rearward end of keeper slot 56 to urge the keeper into continuous contact with the periphery of latch member 12.

A cord channel 62 is formed in body member 10 and extends diagonally from the front surface thereof to the lower surface. If draw cord 20 is to be employed, its free ends are secured in cord channel 62 by means of set screws **63*a* and 63*b* threadedly received in cover member 22 in positions to engage the ends of the draw cord and compress them against the body member. The bight 64 of cord 20 thus extends outwardly of the bowstring release mechanism. The free ends of draw cord 20 may be trimmed, as shown in FIGS. 4 to 7**, so that they will not protrude from the mechanism.

Set screws **63*a* and 63*b* may be omitted and the free ends of draw cord 20 may be knotted outside the mechanism to secure the draw cord in cord channel 62**.

Alternatively, if the draw cord is formed of nylon, for example, heat may be applied to the free ends t melt them, partially, and form enlargements in place of the knots.

Various alternative means may be provided for the archer to grip the bowstring release mechanism or to secure it to his hand or wrist. These are indicated generally at 66 in FIGS. 1 and 2 and at 66, 68 and 70 in FIG. 3. Each is secured to the bowstring release mechanism by means of a stem 72, 74, 76, respectively, stems 74 and 76 being identical in this instance. Each stem is provided with a spherical forward end 78 received in a mating socket 80 provided in body member 10 to provide a swivel connection for flexibility, comfort and convenience in handling the release mechanism. The swiveling feature will be apparent from the contrasting positions of elements 66 as shown respectively in FIGS. 1 and 2.

Operation

Figure 4:
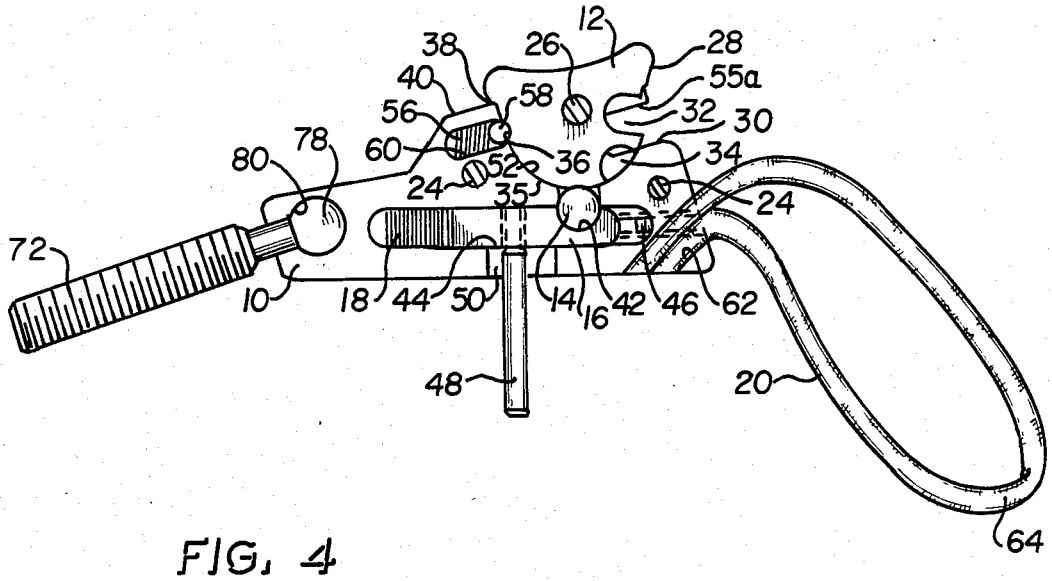
FIG. 4 is a side elevational view of a bowstring release mechanism constructed in accordance with the invention, with a cover member removed to reveal internal elements, some of which are shown in section, and illustrating the mechanism in a first operational condition.

FIG. 4 shows the bowstring release mechanism in the relaxed or uncocked condition. Latch member 12 is held in the relative position shown; namely, with its cord-receiving notch 32 exposed to the exterior of the mechanism and opening forwardly, by means of keeper 58, which is received in keeper notch 36 and held there by the force exerted by keeper spring 60. Sear detent 14 is received in detent notch 42 of sear slide 16 and prevented from moving from this position by cam surface 35 of latch member 12.

Because detent notch 42 is of such form and dimensions that it receives only approximately the lower half of sear detent 14, the latter extends into detent slot 54, the walls of which act to prevent the sear detent from moving in the forward or rearward directions. Accordingly, the sear detent acts to lock sear slide 16 and its depending trigger 48 in the neutral position shown in FIG. 4.

Operation will first be described in relation to the archer who prefers to exert positive finger pressure on trigger 48 to release the bowstring, in the manner of discharging a firearm.

Figure 5:
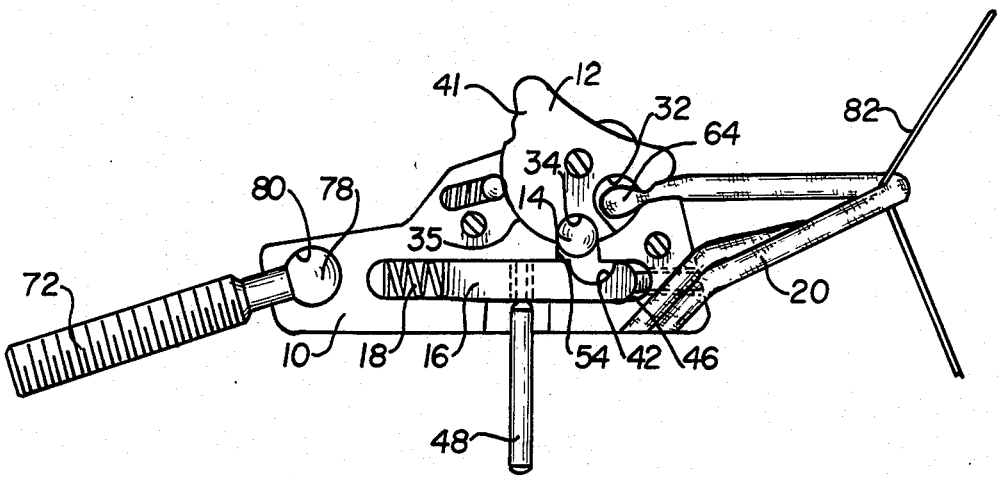
FIG. 5 is a view similar to FIG. 4 but shows the mechanism thereof in a second operational condition.

Draw cord 20 is first looped around a bowstring 82 and the bight 64 of the draw cord first; that is, its looped end portion, is inserted in cord-receiving notch 32 of latch member 12. At the same time, the archer exerts upward finger pressure on cocking lever 41 to rotate latch member 12 in the clockwise direction until sear notch 34 is aligned with sear detent 14. As the latch member is so rotated, bight 64 of the draw cord is caught thereby and retained in cord-receiving notch 32. Alignment of sear notch 34 with sear detent 14 frees the latter to move upwardly to be received in the sear notch; that is, to move to its cocking position, which it now does under the urging of sear slide 16 acting in response to the force exerted on it by sear spring 18. The sear slide continues to move to the right, as viewed in FIGS. 4 and 5, until its forward or right-hand end engages set screw 46, as shown in FIG. 5, to establish a first sear position of the sear slide. The upper surface of sear slide 16 now engages sear detent 14 to hold the latter in sear notch 34. The latter being of such form and dimensions that it receives only approximately the upper half of sear detent 14, the sear detent extends into detent slot 54, the walls of which act to prevent the sear detent from moving in the forward or rearward directions. Accordingly, the sear detent acts to lock latch member 12 in its cocked position.

The archer now pulls the bowstring release mechanism rearwardly to draw bowstring 82. The resulting condition is illustrated in FIG. 5, in which the cocked position of latch member 12 and the cocking position of sear detent 14 are particularly to be noted. It is important to note, too, that throughout the foregoing procedure the archer has refrained from exerting any manual pressure whatsoever on trigger 48.

To release the bowstring, the archer simply engages trigger 48 with his finger and applies pressure to draw it, or "squeeze" it, to the left, as viewed in FIG. 5, to return sear slide 16 to its neutral position in which detent notch 42 is once again aligned with sear detent 14. This permits the sear detent to be moved from its cocking position to return to the detent notch, which it will promptly do under the urging of latch member 12, the latch member itself being urged in the counterclockwise direction by the tension of bowstring 82 acting on draw cord 20.

Figure 7:
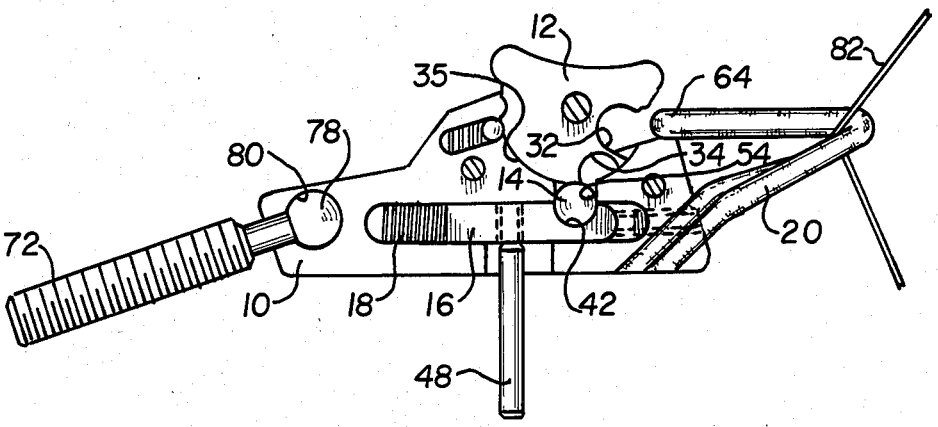
FIG. 7 is a view similar to FIGS. 4, 5 and 6 but shows the mechanism thereof in an instantaneous, intermediate, fourth operational condition.

As soon as latch member 12 has been rotated to the relative position shown in FIG. 7, which shows the mechanism at or about the instant of release, draw cord 20 is released from notch 32, and in the next instant, bowstring 82 will be released from engagement by cord 20. Momentum will normally carry latch member 12 to its original position, as shown in FIG. 4, at which point keeper 58 will again be received in keeper notch 36, and the mechanism will be returned to the uncocked condition illustrated in FIG. 4.

Figure 6:
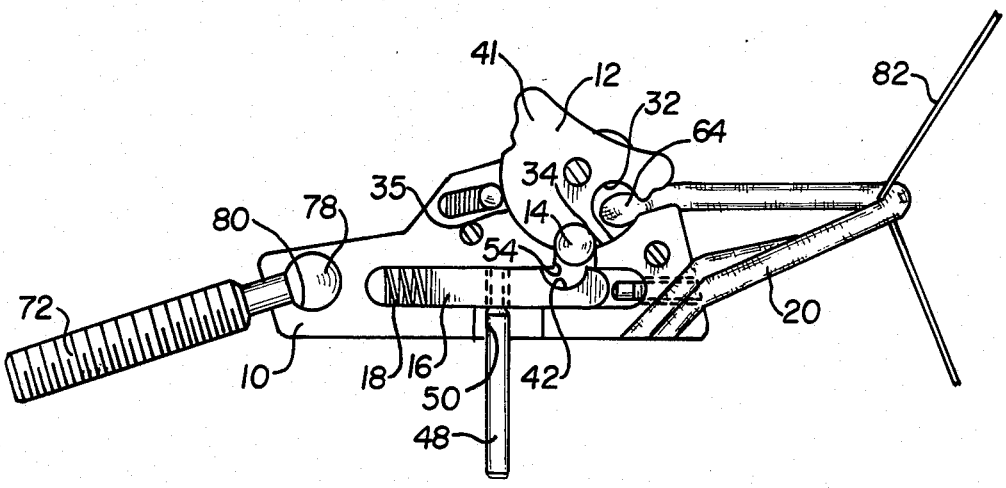
FIG. 6 is a view similar to FIGS. 4 and 5 but shows the mechanism thereof in a third operational condition.

In the case of an archer who prefers to relax or extend his fingers in releasing a bowstring, the procedure is substantially similar to the foregoing, except that during the cocking action, the archer exerts manual or finger pressure on trigger 48 in the left-hand direction as viewed in FIGS. 4 and 6. Thus, when sear notch 34 is aligned with sear detent 14, the latter is forced into the sear notch and thus into its cocking position by the urging of sear slide 16 as it is moved to the left, as viewed in FIG. 6, under the pressure of the archer's finger acting against the urging of sear spring 18. Sear slide 16 can continue to be moved in that direction until trigger 48 engages the rear surface of trigger slot 50. Thus, sear slide 16 continues past sear detent 14, to a second sear position of the sear slide shown in FIG. 6.

The bowstring release mechanism as a whole now being in the condition shown in FIG. 6, sear detent 14 is held in its cocking position in sear notch 34 by sear slide 16, or more particularly, by that portion of the upper surface of sear slide 16 to the right of detent notch 42. Sear detent 14, as before, locks latch member 12 in its cocked position, as shown in FIG. 6. It is important to note that throughout this cocking procedure, the archer has maintained rearward manual pressure on trigger 48. Now, to release bowstring 82, he simply releases trigger 48 from his finger to relieve the manual pressure, whereby the trigger and sear slide 16 will move to the right under the urging of sear spring 18 until the release mechanism arrives at the release condition shown in FIG. 7 and continues to the uncocked condition of FIG. 4, sear slide 16 being returned to its neutral position in the process.

The foregoing procedures have been described for the archer who prefers the mode of operation in which a draw cord is employed. However, as mentioned hereinabove, in an alternative mode, draw cord 20 may be omitted or removed, in which case a portion of bowstring 82 may be received directly in cord-receiving notch 32, as illustrated in FIG. 2. Aside from the omission of draw cord 20, cocking and release procedures are as described above.

It is to be noted that if the dimensions of keeper 58 and keeper notch 36 and the strength of keeper spring 60 are selected accordingly, one-handed operation is possible in this mode of operation. More particularly, instead of employing cocking lever 41, the mechanism may simply be urged forwardly, whereby the force of the taut bowstring acting against the rearward portion of the surface defining notch 32 will rotate the latch member.

While the invention has been particularly described in connection with a certain specific embodiment thereof, and modifications of such embodiment, it is to be understood that this is by way of illustration and not of limitation, and the scope of the appended claims should be construed as broadly as the prior art will permit.

What is claimed is:

1. In a bowstring release mechanism comprising a body member, a latch member mounted on the body member for movement relative thereto to and from a cocked position, the latch member being formed to grasp and hold a cord by a portion thereof upon movement to the cocked position and to release a cord so held upon movement from the cocked position, and sear means carried by the body member for releasably maintaining the latch member in the cocked position, the sear means being manually operable to release the latch member for movement from the cocked position, the improvement wherein the sear means comprises a sear detent movable to and from a cocking position in which it engages the latch member to hold the latch member in its cocked position, a sear actuator movable in opposite directions between first and second sear positions and a neutral position intermediate the first and second sear positions, and biasing means urging the sear actuator in one of said opposite directions, the sear actuator being movable in the other of said opposite directions by application of manual pressure against the urging of the biasing means, the sear actuator being formed to urge the sear detent to its cocking position when the latch member is moved to its cocked position and the sear actuator is moved from its neutral position to one of its first and second sear positions, whereby to hold the latch member in its cocked position, and to permit the sear detent to move from its cocking position when the sear actuator is moved from one of its first and second sear positions to its neutral position, whereby to release the latch member from its cocked position.

2. In a bowstring release mechanism according to claim 1, the further improvement wherein the latch member is formed to hold the sear detent out of its cocking position when the latch member is out of its cocked position.

3. In a bowstring release mechanism according to claim 1, the further improvement wherein the sear detent is movable between said cocking position and a release position in which it engages the sear actuator to hold the sear actuator in its neutral position, the latch member being formed to hold the sear detent in its release position when the latch member is out of its cocked position and to permit the sear detent to move to its cocking position when the latch member is in its cocked position, thereby to release the sear actuator for movement from its neutral position.

4. In a bowstring release mechanism according to claim 1, the further improvement wherein the sear detent comprises a discrete spherical element disposed for reciprocating movement in a detent slot formed in the body member, a first end of the slot being closed by the latch member, a second end of the slot opposite to the first end thereof being closed by the sear actuator.

5. In a bowstring release mechanism according to claim 4, the further improvement wherein the sear actuator comprises an elongated slide disposed in a second slot formed in the body member for reciprocating movement substantially at right angles to the movement of the sear detent, the detent slot intersecting the second slot at an intermediate portion thereof, the slide having a notch portion disposed to receive the sear detent when the sear actuator is in its neutral position.

6. In a bowstring release mechanism according to claim 5, the further improvement wherein the latch member is mounted in a recess formed in the body member for limited rotational movement about an axis normal to the movements of the sear detent and the sear actuator, the detent slot intersecting the recess, the latch member having a notch portion disposed to receive the sear detent when the latch member is in its cocked position, and a cam portion disposed to maintain the sear detent in the notch portion of the sear actuator when the latch member is out of its cocked position.

* * * * *